US008092254B2

(12) United States Patent
Miyazaki et al.

(10) Patent No.: US 8,092,254 B2
(45) Date of Patent: Jan. 10, 2012

(54) WIRE TO BOARD CONNECTOR WITH MULTIPLE CONTACT POINTS

(75) Inventors: Tatsuya Miyazaki, Setagaya (JP); Tomonari Kaneko, Ebina (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/744,951

(22) PCT Filed: Dec. 1, 2008

(86) PCT No.: PCT/US2008/085168
§ 371 (c)(1),
(2), (4) Date: Oct. 26, 2010

(87) PCT Pub. No.: WO2009/073621
PCT Pub. Date: Jun. 11, 2009

(65) Prior Publication Data

US 2011/0045700 A1 Feb. 24, 2011

(30) Foreign Application Priority Data

Nov. 29, 2007 (JP) ..... 2007-309240

(51) Int. Cl.
*H01R 13/648* (2006.01)

(52) U.S. Cl. ..... 439/607.02

(58) Field of Classification Search ... 439/607.02–607.4
See application file for complete search history.

(56) References Cited

U.S. PATENT DOCUMENTS 5,928,035 A * 7/1999 Jankowsky et al. ..... 439/607.36
2006/0121782 A1 6/2006 Shen et al.
2007/0066142 A1 3/2007 Shindo
2007/0087595 A1 4/2007 Shen et al.

FOREIGN PATENT DOCUMENTS

EP 1 326 309 A1 7/2003

OTHER PUBLICATIONS

International Search Report for PCT/US2008/085168.

* cited by examiner

*Primary Examiner* — Phuong Dinh
(74) *Attorney, Agent, or Firm* — Timothy M. Morella

(57) ABSTRACT

A wire to board connector has improved contact reliability and includes a receptacle connector for mounting to a circuit board and a plug connector with a mating blade for insertion into an opening of the receptacle connector. Both connectors have shields that are formed around their exterior and the receptacle connector has an interior shield member that envelops the insertion opening of the receptacle connector. Individual connect legs are formed with this interior shield member and they are spaced apart from each other widthwise of the insertion opening. A contact spring is disposed within the interior of the receptacle connector to exert a contact force on the mating plug connector.

10 Claims, 14 Drawing Sheets

(a)

(b)

(d)

(c)

(a)

(b)

WIRE TO BOARD CONNECTOR WITH MULTIPLE CONTACT POINTS

BACKGROUND OF THE INVENTION

The present invention relates generally to board connectors, and more particularly to wire to board connectors with multiple contact points.

Hitherto, board connectors have been used to connect wires to printed circuit boards, as shown in Japanese Patent Application Laid-Open (Kokai) 2006-172824. Such a connector is mounted on the board and is engaged with a counterpart connector connected to the end of a cable.

FIG. 14 is a perspective view of a shield of such a conventional board connector.

The connector has a shell 871 that is made of metal and arranged to enclose the circumference of a rectangular housing configured that supports a plurality of conductive terminals, thus acting as a shield. The shell 871 has an opening 813, inside of which is accommodated conductive terminal assemblies of the housing and into which is inserted a mating connector (not shown) from the front thereof.

A plurality of ground terminals 876 are formed on the lower surface of the shell 871 for connecting to the circuit board. Tongue-like pieces 875, are disposed between adjacent ground terminals 876. Each tongue piece is provided with a contact spring 874, which contacts the metallic shell of the mating connector inserted into the opening 813. The contact spring 874 has its rear end connected to the tongue piece 875, and a front end which is a free end formed as a cantilever and elastically displaceable vertically. This structure allows the contact spring 874 to contact the metallic shell of the mating connector. A side ground terminal 878 is formed on each side face of the shell 871 for attachment to the circuit board.

SUMMARY OF THE INVENTION

In case of this conventional board connector, the contact spring 874 is a spring that extends in the insertion/removal direction of the mating connector. In order to enhance the contact force of the contact spring 874 to ensure good mating contact with the connector, it is necessary to increase the overall size of the contact spring 874. This increases the size of the shell 871 and housing. This conventional connector cannot be miniaturized.

Therefore, an object of the present invention is to solve the above-mentioned problems encountered by the conventional board connector by providing a reliable board connector with a plurality of legs connected to the circuit board and a spring part configured to extend widthwise of the connector insertion opening that receives as the mating connector and which is supported by the legs at both ends thereof, the legs and spring part being formed at the insertion opening, thereby obtaining a sufficient contact force by way of a thinned spring part, maintaining a secure contact, and further maintaining a secure connection between the legs and the conductive pads of the circuit board, thereby providing high shielding and reduced size.

In order to achieve the above-mentioned object, the present invention provides a board connector comprising a housing having a circumference thereof defined by a top plate, a bottom plate, and side walls, and the housing having an opening that receives part of a mating connector, a shield member having at least a part thereof arranged forward of the bottom plate and configured to contact with a mating shield member while covering at least a part of the exterior of the housing, wherein the shield member comprises a plurality of legs connected to the circuit board and facing a lower surface of the bottom plate, and a spring part extending widthwise along the insertion opening, with both ends thereof supported by the legs, and wherein the spring part is elastically displaced, when the mating connector is inserted into the opening.

In accordance with another embodiment of the present invention, each of the legs is formed by bending down a projecting piece protruding from the opening shield member.

In a further embodiment of the present invention, the spring part comprises a projection arranged on a surface thereof.

In accordance with a still further embodiment of the present invention, the spring part comprises a guide part extending obliquely downward in a forward direction from a front end thereof.

In yet a further embodiment of the present invention, the spring part is elastically displaced downward when the mating connector is inserted into the insertion opening.

In accordance with a further embodiment of the present invention, a distance is provided between the spring part and the board and is set so the spring part does not contact the circuit board even when displaced downward.

In accordance with a still further embodiment of the present invention, each of the legs include a connecting leg part positioned below the opening shield member and configured to contact the circuit board, wherein the connecting leg part has a curved side shape and is formed, by folding, with a base part connected to the opening shield member and a free end.

In accordance with the present invention, the board connector is provided with a shield member, which is arranged at an insertion opening and is formed with a plurality of legs connected to the circuit board and a spring part extending widthwise of the insertion opening and having both ends thereof supported by the legs. This configuration permits the springs to obtain a sufficient contact force, while maintaining a secure contact by the elasticity of the thinned spring part of the board connector, and also maintaining a secure connection between the legs and the conductive land of the board, thereby providing a high shield property, allowing reduction in the entire height of the board connector, and enhancing the contact reliability.

DESCRIPTION OF THE PREFERRED EMBODIMENTS

Figure 1:
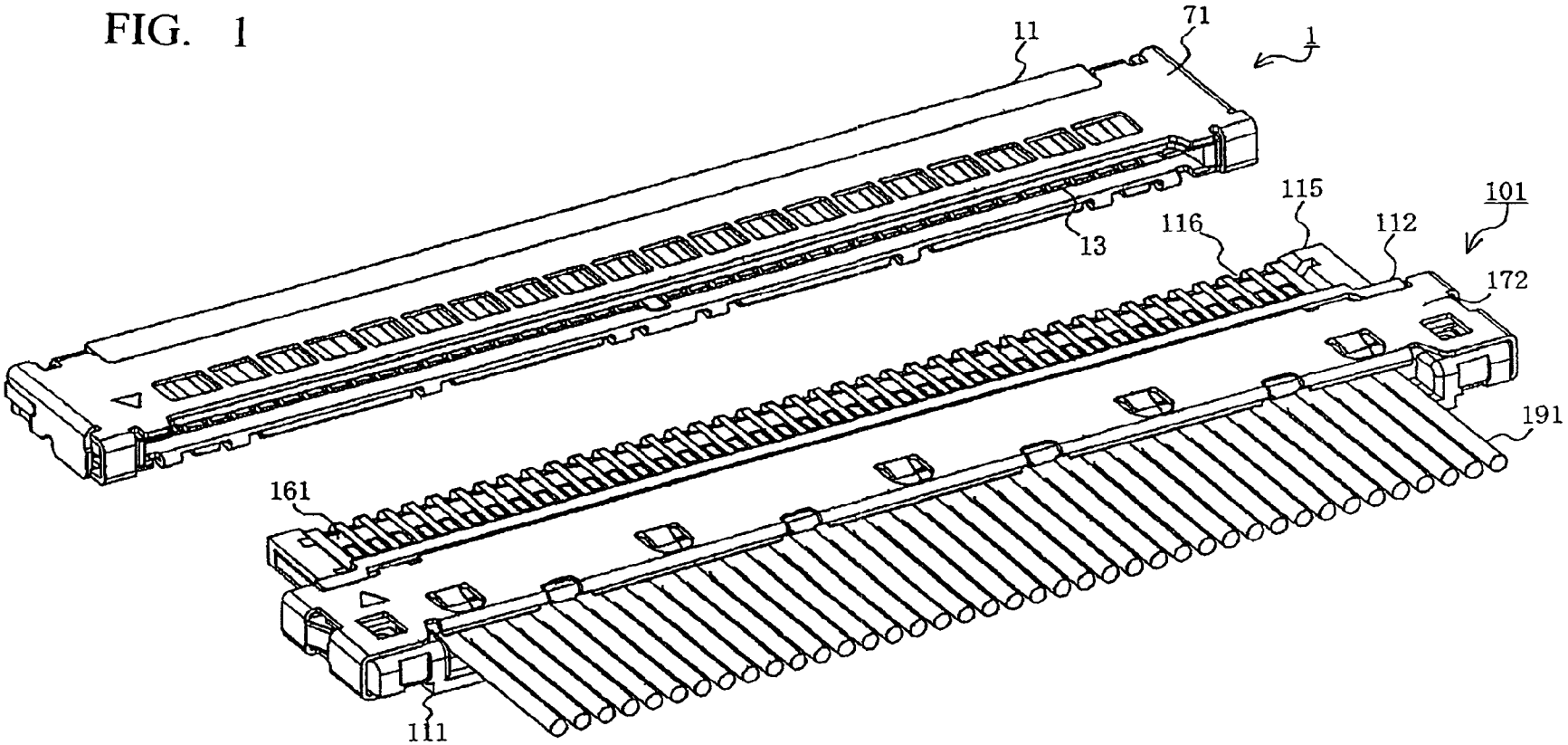
FIG. 1 is a perspective view of a board connector of the present invention and a mating connector before being fitted together.

In the drawings, reference numeral 1 represents a receptacle connector used as a board connector that is mounted to a circuit board 91. A plug connector 101 serves as a mating connector in this embodiment. The plug connector 101 is connected to the end of a cable that houses a plurality of conductive wires 191 and is mated to the connector 1 so as to connect the cable and connector 1 together.

In this embodiment, the plug connector 101 may be intended to connect a flexible flat cable such as an FFC (Flexible Flat Cable), FPC (Flexible Printed Circuit), or rigid circuit board rather than a cable with conductive wires 191 having a circular cross section as shown in the figure. The board 91 on which the receptacle connector 1 is mounted is a printed circuit board included in an electronic device. The electronic device may include a personal computer, a cell phone, a PDA (Personal Digital Assistant), a digital camera, a video camera, a music player, a game machine, a vehicle-mounted navigation system, or the like, although it may be a device of any kind.

The receptacle connector 1 is mounted on a circuit board included in a small-size electronic device. The receptacle connector 1 may be a compact, low-profile board connector having maximum external dimensions of a width of about 20 mm, a depth of about 5.5 mm, and a height of 1 mm or less, and it includes a plurality of terminals 61 that are arranged widthwise with a pitch of 0.5 mm or less.

The plug connector 101 includes a housing 111 formed by an insulating material such as a synthetic resin, a terminal 161 comprised of a conductive material and loaded in the housing 111, and a plug shield member 171 comprised of a thin plate of a conductive material and configured to cover at least a part of the exterior, or circumference, of the housing 111.

Figure 2:
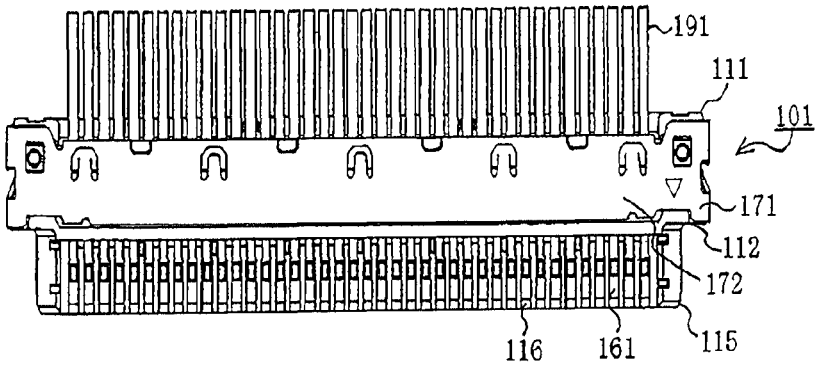
FIG. 2A is a top view of the mating connector of FIG. 1.
FIG. 2B is a front elevational view of the mating connector of FIG. 1.
FIG. 2C is a bottom plan view of the mating connector of FIG. 1.
FIG. 2D is a side elevational view of the mating connector of FIG. 1.
Figure 2:
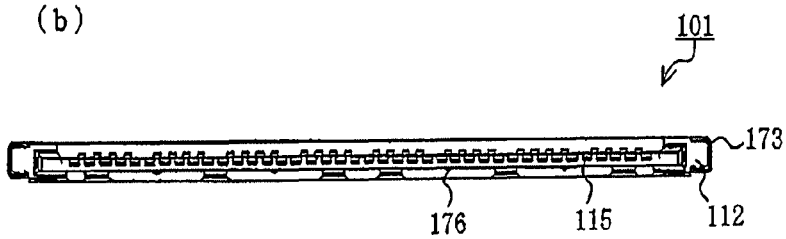
Figure 2:
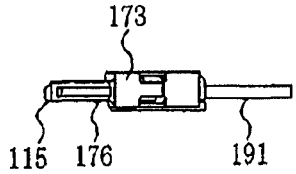
Figure 2:
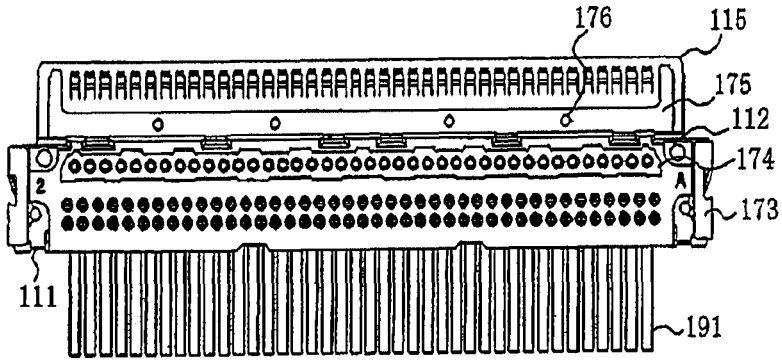
Figure 3:
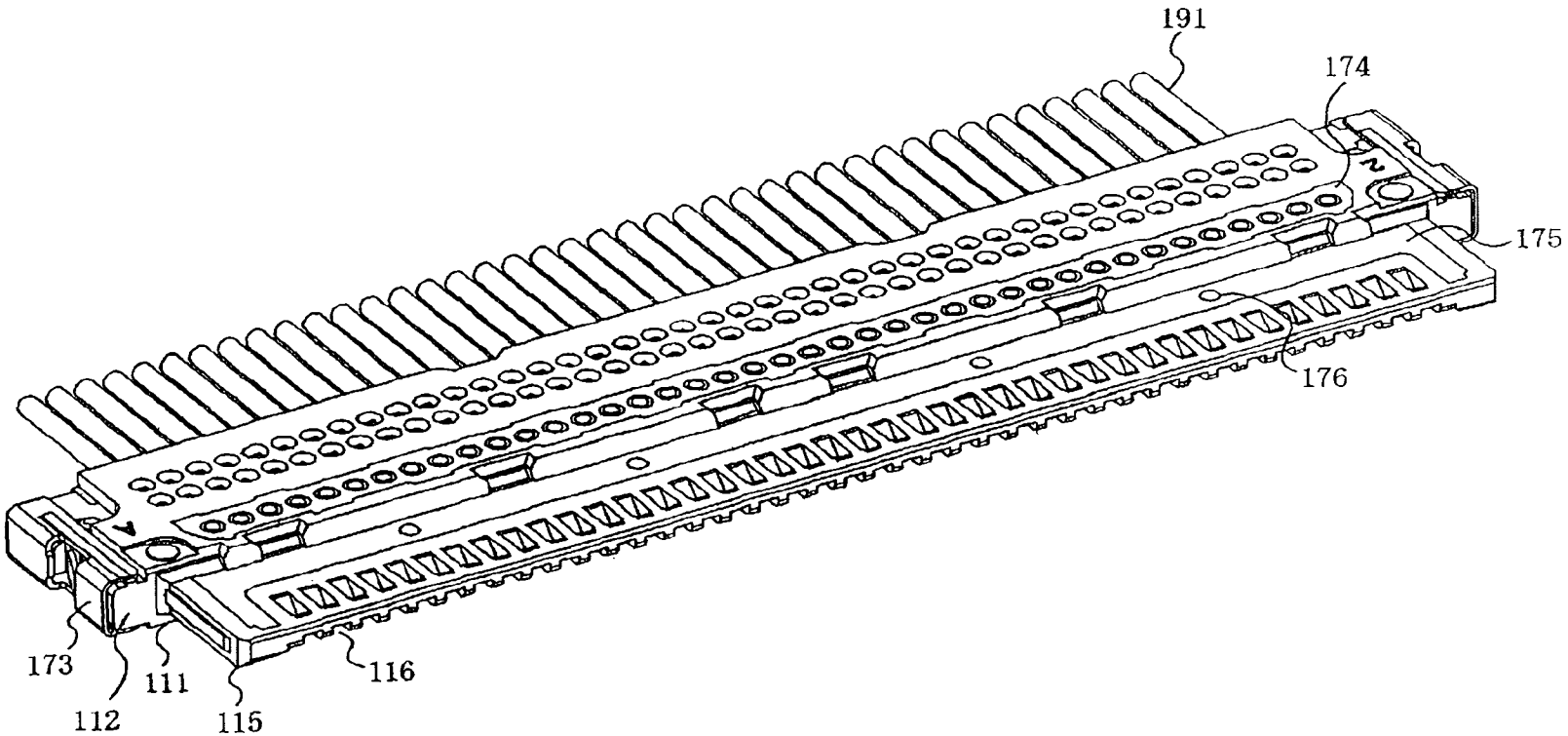
FIG. 3 is a perspective view of the mating connector constructed in accordance with the principles of the present invention, with the lower surface facing upward.

The housing 111 includes an insertion part 115 inserted into an insertion opening 13 of the connector 1. The insertion part 115 is a plate-shaped part that extends forward (downward in FIG. 2A) from the front surface of a body 112 of the housing 111 and has a plurality of terminal grooves 116 formed on its upper surface. The tip of each terminal 161 is received and exposed in each accommodating groove 116. The terminals 161 are arranged widthwise in the connector 101 (horizontal in FIG. 2A) at a predetermined pitch at, for example, 0.5 mm or less. The rear end of each terminal 161 is retained by the body 112 of the housing 111 inside the body 112 and is further connected to a core lead of each conductive wire 191 inserted in the body 112 from behind (above in FIG. 2A).

The shield member 171 includes an upper surface shield member 172 covering at least a portion of the upper surface of the body 112 of the housing 111, a side surface shield member 173 covering at least a portion of the side surface of the body 112 of the plug housing 111, a lower surface shield member 174 covering at least a portion of the lower surface of the body 112 of the plug housing 111, and an insertion shield member 175 covering at least a portion of the lower surface of the insertion part 115 of the housing 111. The upper surface shield member 172, the side surface shield member 173, the lower surface shield member 174 and the insertion shield member 175 are connected to and conductive with each other. At least one projection 176 (four such projections in the figures) protruding downward is formed to be arranged on the insertion shield member 175.

When the insertion part 115 is inserted into the insertion opening 13 of the connector 1 to fit the connector 101 to the connector 1, the shield member 171 is connected to and conductive to a receptacle shield member 71 covering the circumference of a housing 11 of the receptacle connector 1. More specifically, the insertion part shield member 175 contacts the insertion opening shield member 75.

The receptacle connector 1 is provided with a housing 11 formed from an insulating material, a plurality of terminals 61 comprised of a conductive material and loaded in the housing 11, and a receptacle shield member 71 that is comprised of a thin conductive plate and which covers a portion of the exterior of the housing 11.

Figure 4:
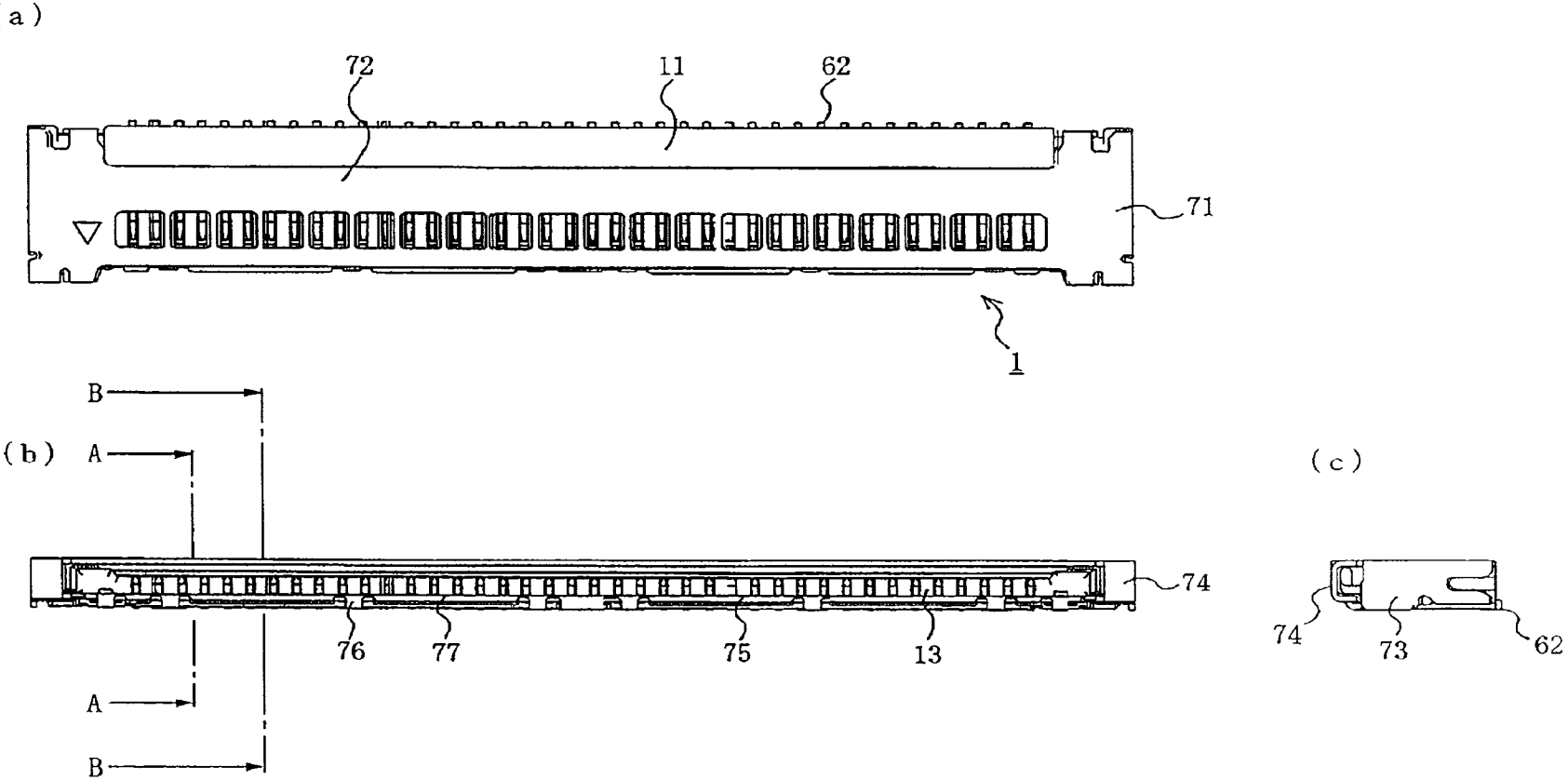
FIG. 4A is a top plan view of the board connector constructed in accordance with the present invention.
FIG. 4B is a front elevational view of the board connector of FIG. 4A.
FIG. 4C is a side elevational view of the board connector of FIG. 4A.

The terminal 61 may be stamped and formed. The terminal 61 has a tail part 62 that extends backward from the lower side and is connected to a signal pad in the surface of the board 91 such as soldering. It also has an upper arm 63 that extends forward from the upper side of the terminal body, and a lower arm 64 that extends forward from the lower side of the body. A contact 65 protrudes downwardly and is formed in the vicinity of the tip of the upper arm 63. The terminal 61 has its body held in the housing 11. The terminals 61 are arranged side-by-side widthwise of the connector 1 (horizontal in FIG. 4A) at a predetermined pitch of, for example, 0.5 mm or less.

Figure 7:
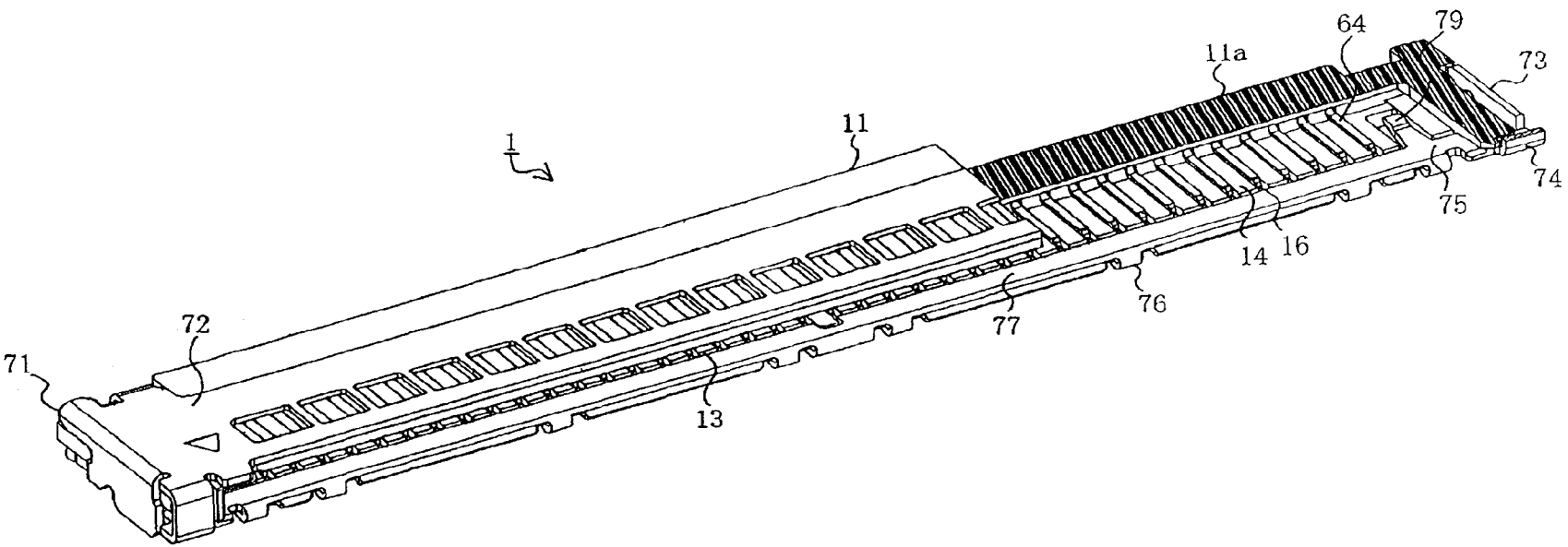
FIG. 7 is the same view as FIG. 6, with a part thereof removed for clarity.
Figure 8:
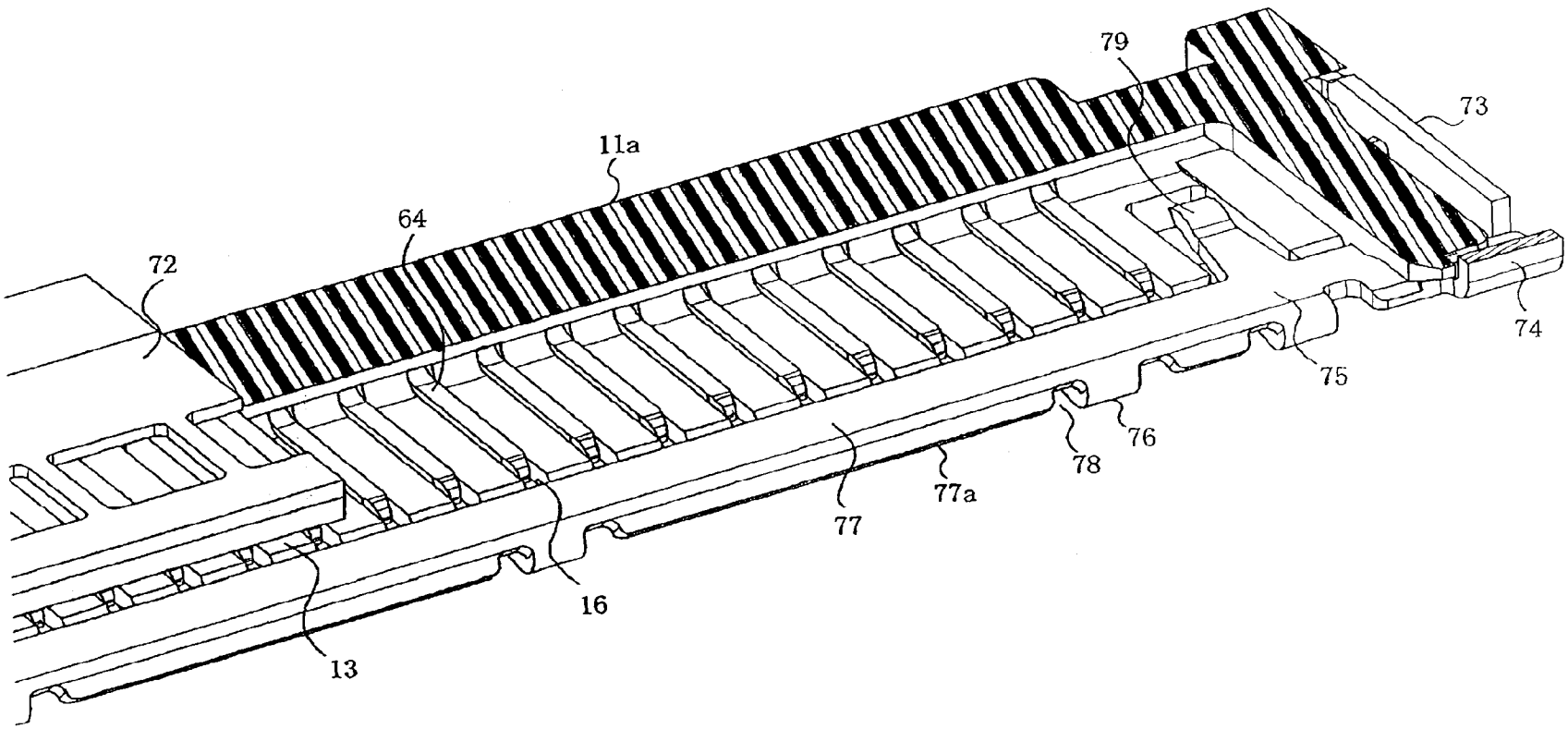
FIG. 8 is an enlarged detail view of the cutaway portion of FIG. 7.

The housing 11 includes a top plate 12 and a bottom plate 14 that extend parallel with each other and side walls 15 that extend vertically at both ends of the connector 1, as well as connecting the top plate 12 and the bottom plate 14 to each other. A narrow slot-shaped insertion opening 13 extends widthwise of the connector 1, and the opening 13 is defined by the top plate 12, the bottom plate 14, and the side walls 15. A plurality of arm accommodating grooves 16 accommodate at least a part of the lower arm 64 of each of terminal 61 and are formed on the upper surface of the bottom plate 14. As shown in FIGS. 7 and 8, the terminal body 61 is retained in the innermost wall part 11*a* of the housing 11, and the lower arm 64 extends forward into the insertion opening 13 from the innermost wall part 11*a*.

The receptacle shield member 71 may be integrally formed by stamping it from a metal plate and forming it. The receptacle shield member 71 includes an upper shield member 72 as an upper shield member covering a portion of the upper surface of the top plate 12 of the housing 11, a side shield member 73 as a receptacle side shield member covering a portion of the side surface of the side wall 15 of the receptacle housing 11, an insertion opening shield member 75 as a receptacle lower shield member partially arranged ahead of the bottom plate 14 of the receptacle housing 11, and a connecting shield member 74 as a receptacle connecting shield member configured to extend in the direction of height at both ends of the connector 1 that connect the upper shield member 72 and the insertion opening shield member 75 to each other. The upper shield member 72, the side shield member 73, the insertion opening shield member 75, and coupling shield member 74 are connected to and are conductive with each other.

Figure 5:
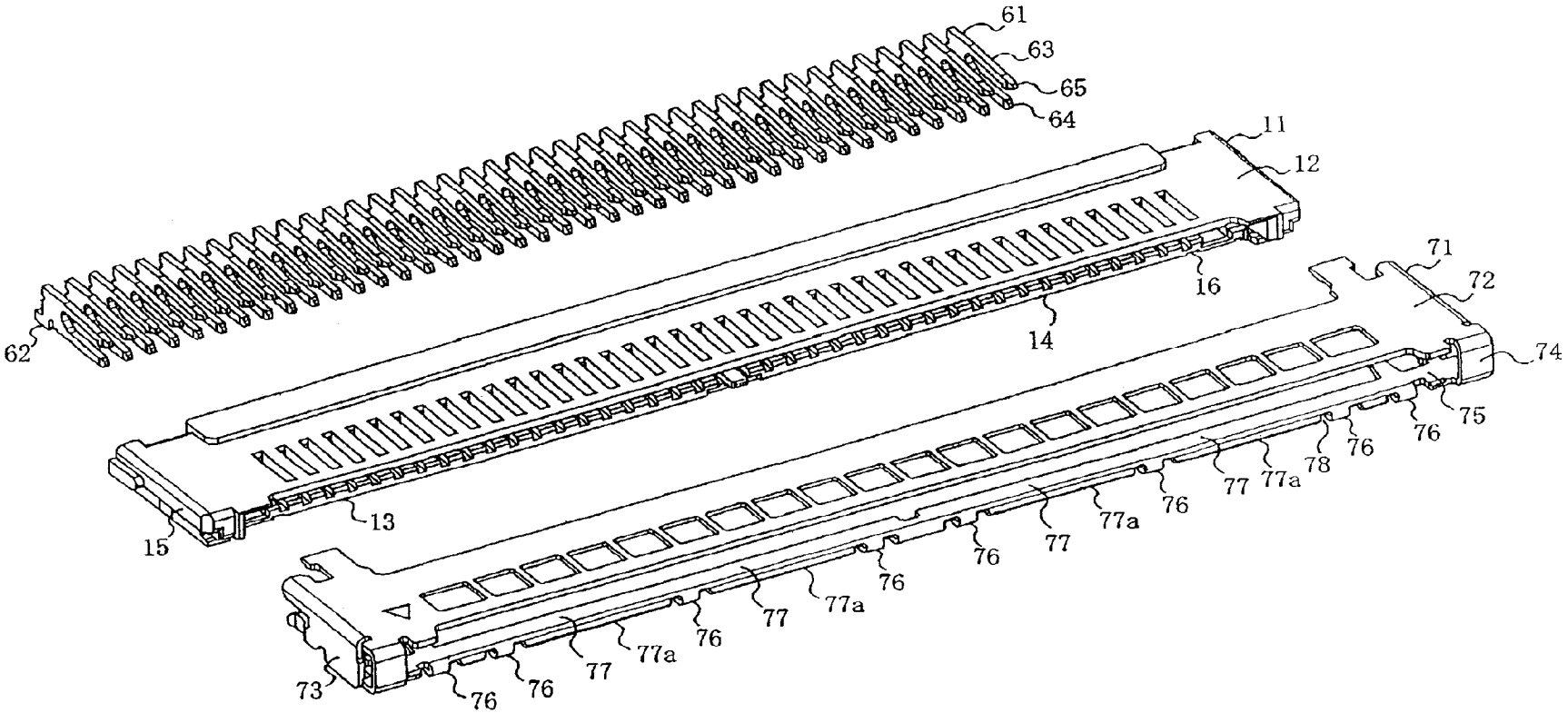
FIG. 5 is an exploded view of the board connector of FIG. 4A.
Figure 6:
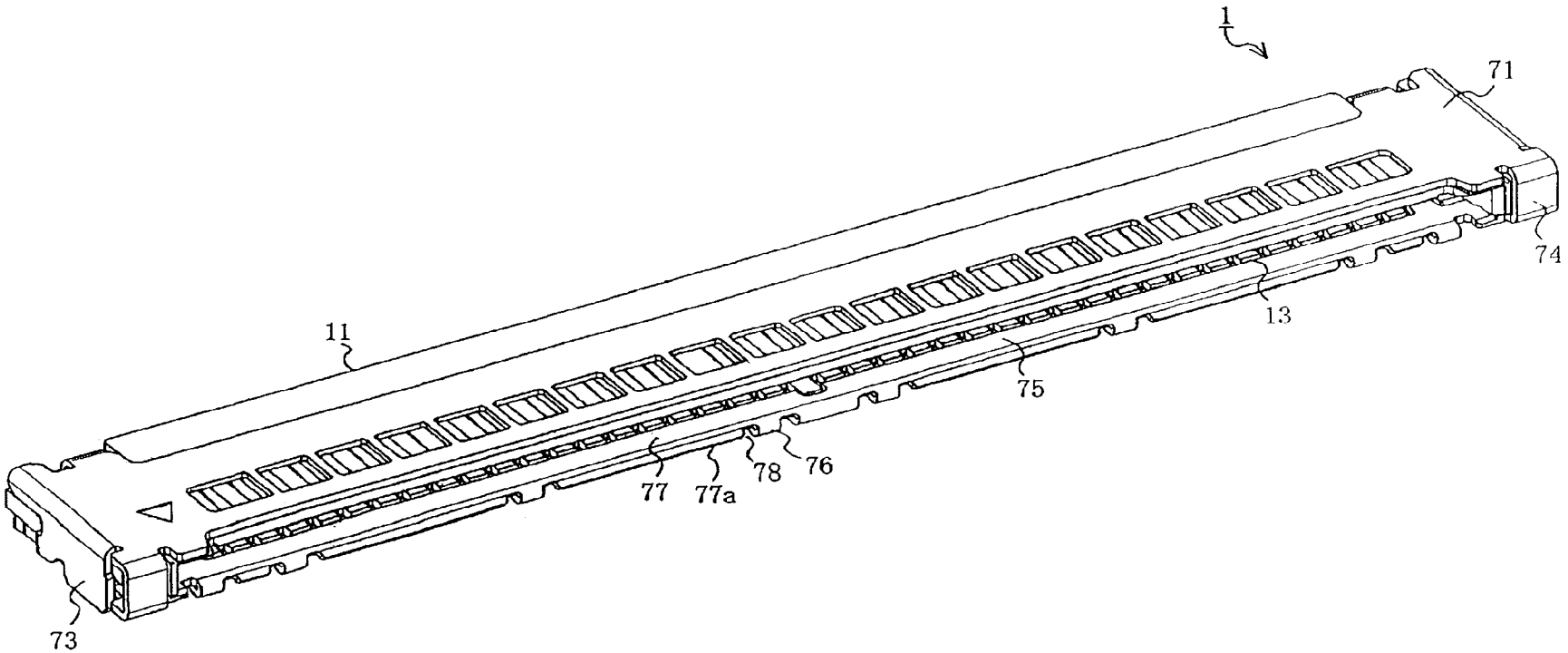
FIG. 6 is a perspective view of the front face board connector of FIG. 4A.

The insertion opening shield member 75 is a slim, elastic thin plate member extending widthwise of the connector 1, and is positioned ahead of the front edge of the bottom plate 14 at the front end of the insertion opening 13 (the lower end of FIG. 4A) and has both ends of it connected to the coupling shield member 74. The insertion opening shield member 75 includes a leg part 76 that can be connected to a ground pad provided on the surface of the board 91 such as soldering, and a spring part 77 that extends widthwise of the insertion opening 13 and it includes both ends thereof supported by the adjacent legs 76. The number of the legs 76 is arbitrary but it is preferred to have two or more legs. In FIG. 5, the number of the legs 76 is 8, and the number of the spring parts 77 may also be arbitrary as long as it is 1 or greater. In FIG. 5, the number of the spring parts 77 is four.

As shown in FIGS. 7 & 8, auxiliary contacts 79 that extend backward are formed near both ends of the insertion opening shield member 75. This auxiliary contact 79 is a cantilever-shaped member whose base is connected to the insertion opening shield member 75. The auxiliary contacts 79 extend so as to cover a part of the upper surface of the bottom plate 14 and is pushed to come into contact with the insertion shield member 175 when the mating connector 101 is inserted into the insertion opening 13. The auxiliary contacts 79 may be omitted if desired.

Figure 9:
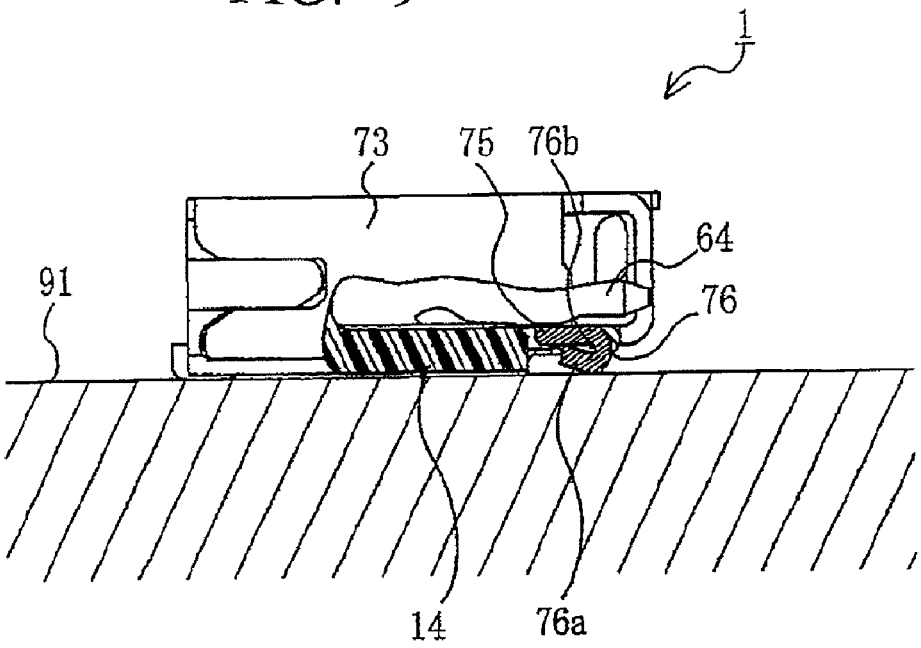
FIG. 9A is a partial cross-sectional view of the board connector of FIG. 4, taken along line A-A in FIG. 4.
FIG. 9B is a partial cross-sectional view of the board connector of FIG. 4, taken along line B-B in FIG. 4.
Figure 9:
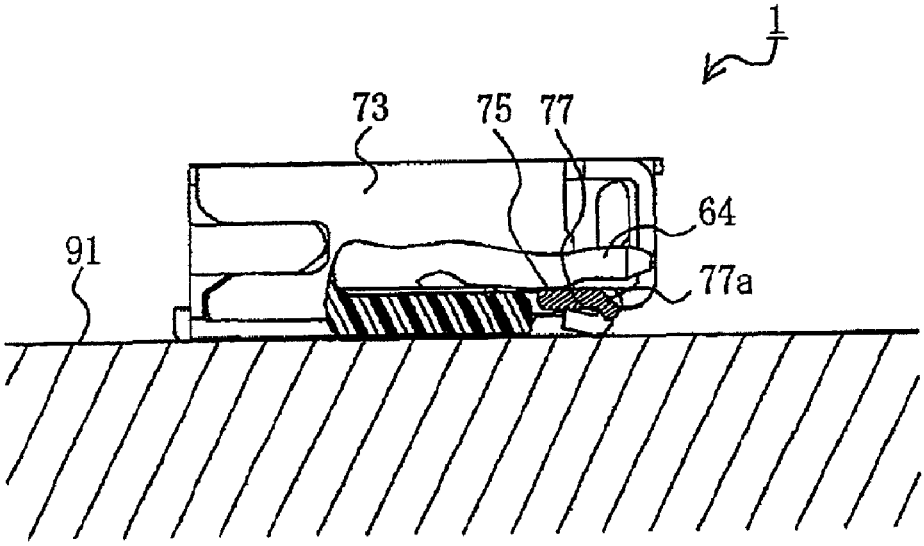

The leg 76 whose cross-section is shown in FIG. 9A is formed by bending down a projecting piece protruding ahead of the front end of the insertion opening shield member 75. The leg 76 includes a connecting leg part 76*a* positioned below the insertion opening shield member 75, and configured to abut the ground pad of the board 91. In this embodiment, the connecting leg part 76*a* has a curved side shape that is folded and is spaced apart from the surface of the board 91, and at a free end (the tip side of the projecting piece). This curved side shape keeps the connecting leg part 76*a* to be separated apart from the lower surface of the insertion opening shield member 75 rather than keeping them into close contact and thus a cavity portion 76*b* is formed therebetween.

In case the leg 76 is connected to the ground pad of the board 91 via soldering, molten solder comes into the portion between the lower surface of the connecting leg part 76*a* and the surface of the board 91, which forms a solder fillet that is very strong. The upper surface of the connecting leg part 76*a* does not contact the lower surface of the body of the insertion opening shield member 75, and the cavity portion 76*b* is formed therebetween. The presence of the cavity portion 76*b* prevents solder wicking. In other words, solder does not directly adhere to the upper surface of the insertion opening shield member 75 and/or the spring part 77.

While the leg 76 is formed by bending down a projecting piece and folding the tip thereof to face backward so as to be positioned between the insertion opening shield member 75 and the board 91, the leg 76 may also have a shape where the tip is bent to face downward as long as a predetermined height from the board is maintained. The projecting piece may also be formed to connect from the rear end side rather than the front end side of the insertion opening shield member 75.

The spring part 77 is a thin plate member having a slim belt shape, and has both ends thereof supported by the legs 76, thus functioning as both-sided plate spring and coming into contact with the insertion part shield member 175 of the insertion part 115 of the plug connector 101 inserted into the insertion opening 13. As shown in FIG. 9B, the spring part 77 has a lower surface thereof that is spaced apart from the surface of the circuit board 91. The spring part 77 is thus elastically deformed and displaced downward when pushed downward by the insertion part shield member 175 of the mating connector when the insertion part 115 thereof is inserted into the insertion opening 13 of the board connector. A reaction force generated by the elastic deformation pushes the spring part 77 against the insertion part shield member 175. This securely maintains a contact between the spring part 77 and the insertion part shield member 175, thus surely maintaining electrical continuity between the insertion opening shield member 75 and the insertion part shield member 175.

The distance between the lower surface of the spring part 77 and the surface of the board 91 is previously designed and set, for example, by adjusting the height of the projection 176, to a certain degree so that the lower surface of the spring part 77 does not abut against the surface of the board 91 even when the spring part 77 is displaced downward when the mating connector insertion part 115 is inserted. This prevents the insertion part 115 from abutting against the surface of the circuit board 91 when mating.

The lower surface of the spring part 77 does not abut against the circuit board 91. Thus, a conductive trace may be located on the circuit board 91 corresponding to the lower surface of the spring part 77. In this embodiment, it is possible to wire a conductive trace in a range corresponding to the lower surface of the spring part 77 so that the conductive trace passes below the connector 1, which enhances the degree of freedom in wiring of conductive traces and also the degree of freedom of board design.

The spring part 77 extends widthwise with a relatively large dimension relative to the depth of the insertion opening 13. Thus, it is possible to increase the length of a portion of the spring part 77 elastically deformed to function as a spring, that is, the spring length. By increasing the spring length as required, it is possible to obtain a stable contact when mating.

The spring part 77 supported by the legs 76 functions as a two-sided plate spring and is more likely to reserve an elastic region than a one-sided plate spring, only one end of which is supported and provides a greater reaction force on elastic deformation. It is unnecessary to increase the plate thickness of the spring part 77 to obtain a high contact force. It is possible to form an insertion opening shield member 75 as a thin plate, thus making it possible to reduce the height of the receptacle connector. A sufficient contact force is obtained without increasing the displacement amount of the spring part 77. It is thus unnecessary to set a wide range where the spring part 77 is freely displaceable vertically. This also reduces the height of the connector 1.

By soldering the folded part 76 as a leg part onto the board, the spring part 77 is formed into a beam both ends of which are fixed and supported to obtain a greater contact force.

In the illustrated example, a guide part 77*a* configured to extend obliquely downward in a forward direction is connected to the front end of the spring part 77. As shown in FIG. 9B, the upper surface of the guide part 77*a* is a tilting surface that is tilted obliquely downward in a forward direction. When the insertion part 115 is inserted into the insertion opening 13, the lower end of the insertion part 115 is guided by the tilting surface, which smoothly guides the insertion part 115 to be induced into the insertion opening 13.

The cross section of the spring part 77 including the guide part 77*a* connected thereto forms a "chevron"-style shape shown in FIG. 9B. The spring part 77 is less likely to bend with respect to the direction of bending (vertically in FIG. 9B) than without the guide part 77*a*. This allows adjustment to increase the contact force of the spring part 77. As described above, it is unnecessary to increase the plate thickness of the spring part 77 and set a wide range where the spring part 77 is displaceable in the direction of the height of the receptacle connector 1, thereby making it possible to suppress the height of the receptacle connector 1.

In this embodiment, while the cross-section of the spring part 77 has a "chevron" shape, the cross section may also have an arc shape.

A notch 78 is provided between the guide part 77*a* and each of the legs 76 supporting the both ends of the spring part 77. By adjusting the size of the notch 78, it is possible to adjust the dimension of the connecting part between the spring part 77 and the legs 76 and the dimension of the guide part 77*a* to adjust the elasticity of the spring part 77.

The dimension of the guide part 77*a* and the tilting angle of the guide part 77*a* with respect to the spring part 77 may be set as required. For example, when a larger tilting angle of the guide part 77*a* with respect to the spring part 77 is set, the spring part 77 is less likely to be deformed so as to provide a greater contact force with the shield member of a counterpart connector. Furthermore, the guide part 77*a* may be omitted as required if unnecessary.

Figure 10:
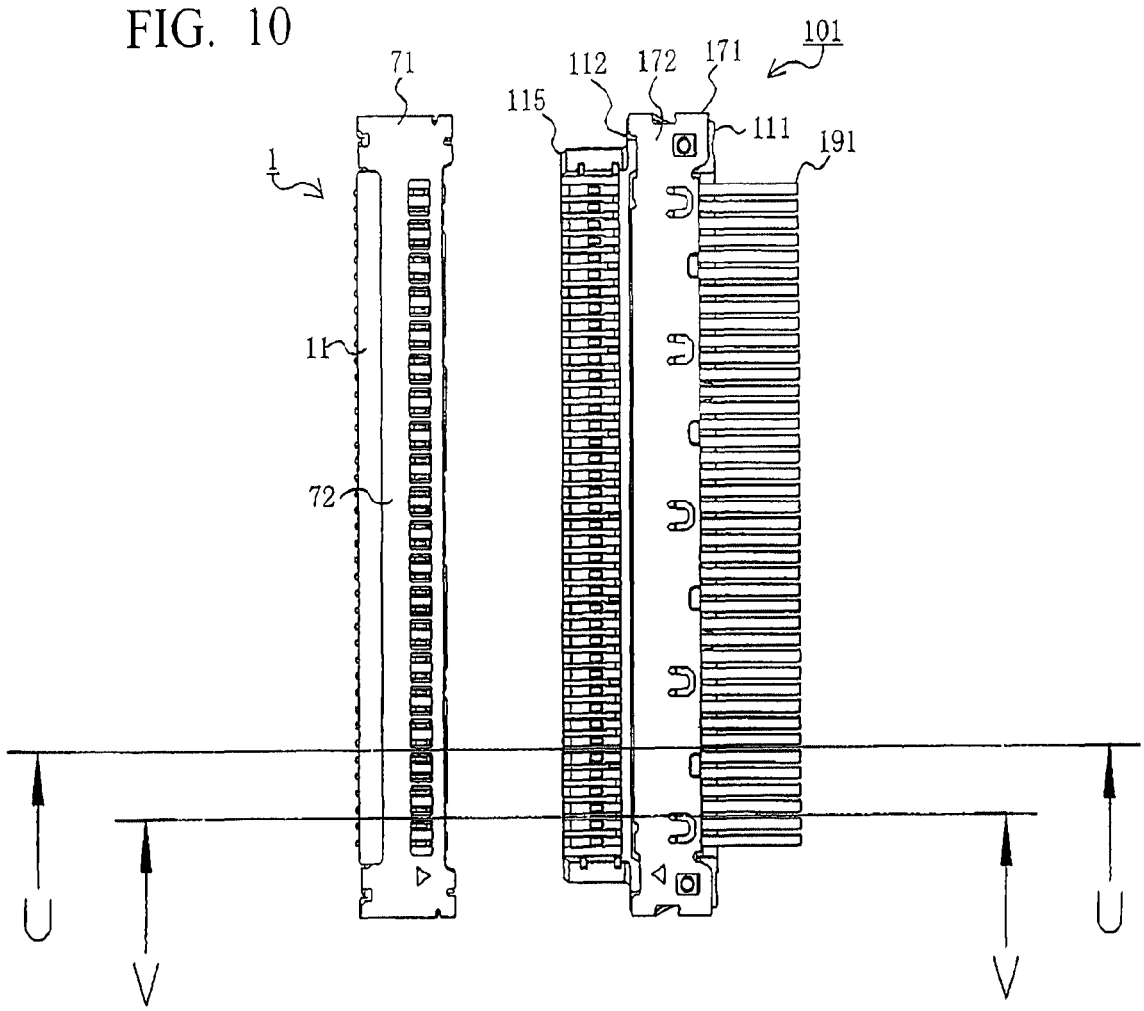
FIG. 10 is a top plan view of the board connector and a mating connector prior to engagement.
Figure 11:
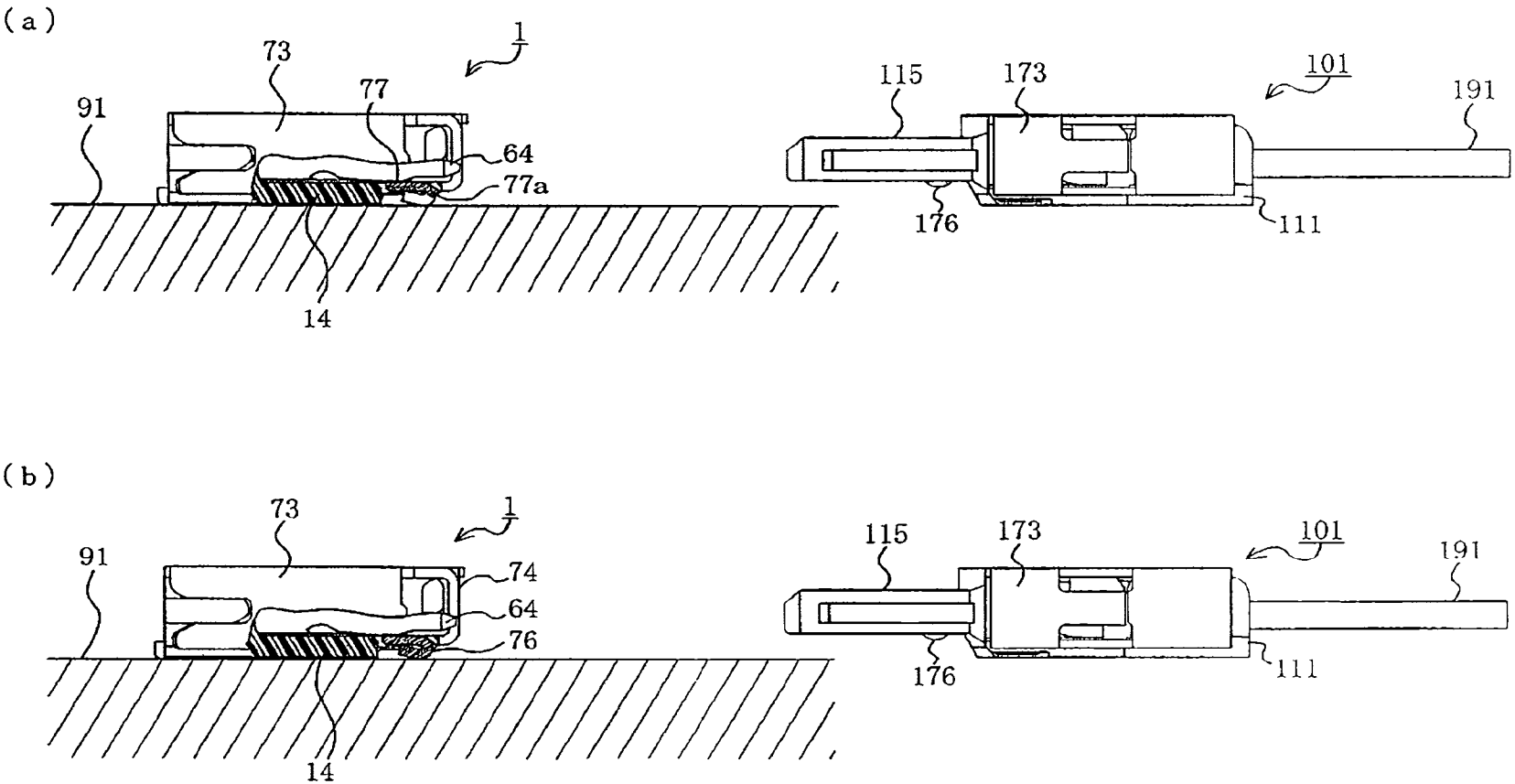
FIG. 11A is a partial cross-sectional view of the board connector of FIG. 10, taken along line U-U thereof.
FIG. 11B is a partial cross-sectional view of the board connector of FIG. 10, taken along line V-V thereof.
Figure 12:
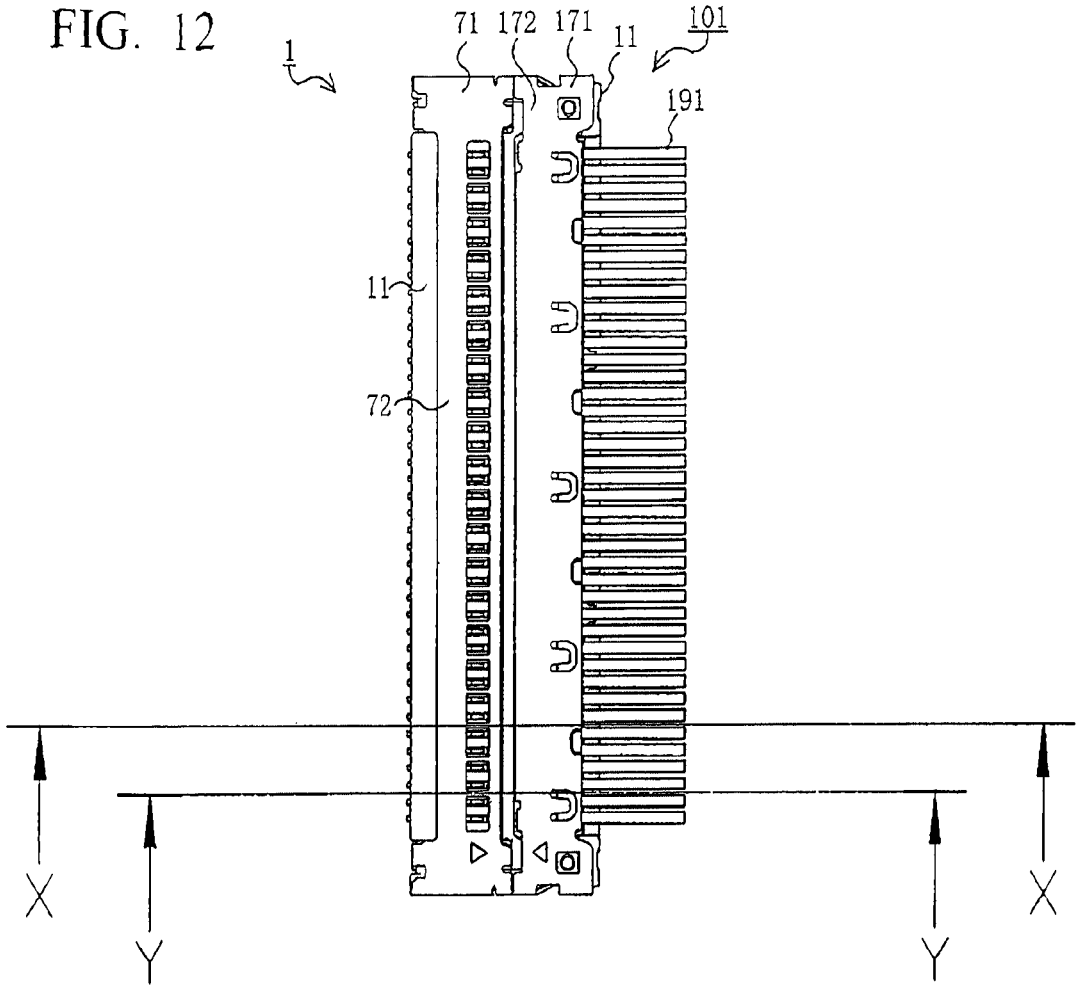
FIG. 12 is a top plan view of the board connector and mating connector fitted together.

The receptacle connector 1 in FIGS. 10-12 is a right-angle type connector and the connector 1 is mounted laterally on the circuit board 91 with the lower surface of the bottom plate 14 of the receptacle housing 11 facing the surface of the board 91. The insertion opening 13 extends parallel with the board 91 and the front surface of the insertion opening 13 is substantially vertical with respect to the board 91.

An operator manipulates the mating plug connector 101 with his or her fingers or the like and orients the front surface of the insertion part 115 of the connector 101 even with the insertion opening 13 of the connector 1, as shown in FIGS. 10 and 11.

Next, the connector 101 is moved toward the connector 1, and the insertion part 115 of the connector 101 is inserted in the insertion opening 13 of the connector 1. The lower end of the insertion part 115 is guided by the tilting surface of the guide part 77*a* of the insertion opening shield member 75 and thus the insertion part 115 is smoothly inserted in the insertion opening 13.

Figure 13:
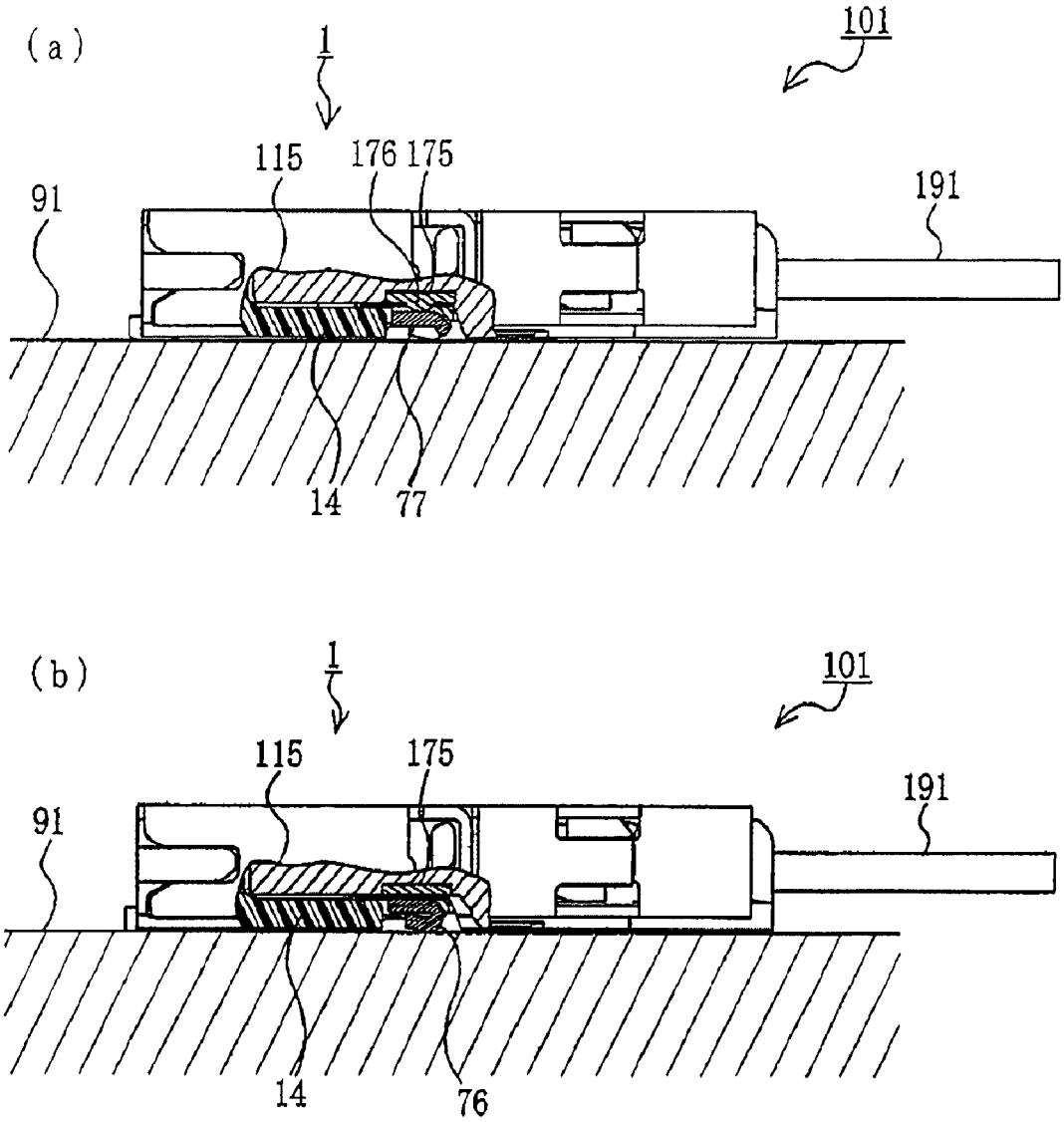
FIG. 13A is a partial cross-sectional view of the mated connectors of FIG. 12, taken along line X-X thereof.
FIG. 13B is a partial cross-sectional view of the mated connectors of FIG. 12, taken along line Y-Y thereof.
Figure 14:
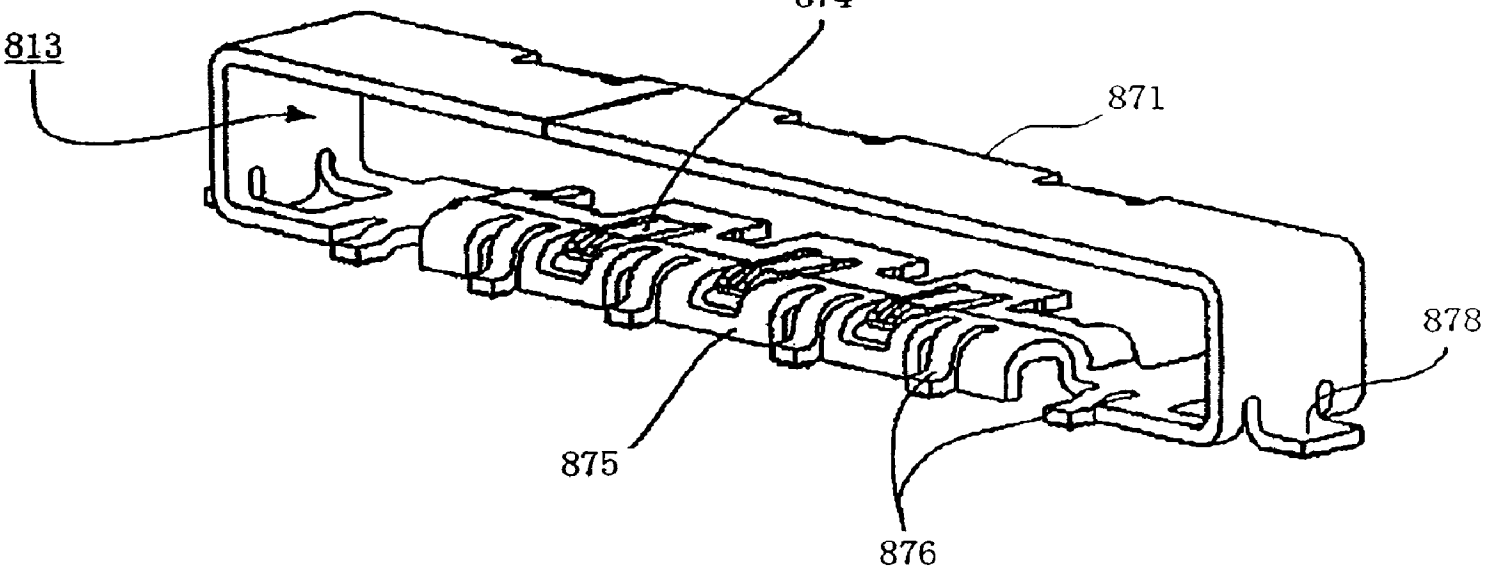
FIG. 14 PRIOR ART
FIG. 14 is a perspective view of a shell of a conventional board connector.

When the insertion part 115 of the plug connector 101 is inserted as deep as the innermost area of the insertion opening 13 of the connector 1, the connector 101 and the connector 1 are fully engaged with each other as shown in FIGS. 12 and 13.

In this case, as shown in FIG. 13A, the projection 176 formed on the insertion part shield member 175 abuts against the upper surface of the spring part 77 of the insertion opening shield member 75 to thereby displace the spring part 77 downward.

The projection 176 is desirably formed in a position corresponding to the center with respect to the width of the insertion opening 13 at each spring part 77. Thus, the spring part 77, both ends of which are supported by the legs 76, is displaced to take a horizontally symmetrical shape and to exhibit an appropriate elasticity.

As shown in FIG. 13A, even when the spring part 77 abuts against the projection 176 and is displaced downward, the lower surface of the spring part 77 does not abut the surface of the circuit board 91. The spring part 7 produces a reaction force through elastic displacement. This reaction force pushes the spring part 77 onto the insertion part shield member 175. This maintains a contact between the spring part 77 and the insertion part shield member 175 with certainty, thereby surely maintaining electrical continuity between the insertion opening shield member 75 and the insertion part shield member 175. For example, even in case an external force such as torsion is exerted on the plug connector 101 via the wire 191, the plug connector 101 in an elastically deformed shape follows the variation, thus surely maintaining electrical continuity between the insertion opening shield member 75 and the insertion part shield member 175.

The contact part of the spring part 77 on the insertion part shield member 175 is a small portion of the projection 176 so that the contact pressure per unit area at the contact part becomes higher. This exerts a wiping operation to remove dirt or the like on the surface upon contact between the spring part 77 and the insertion part shield member 175, which securely maintains electrical continuity with a reduced resistance, thereby more securely maintaining electrical continuity between the insertion opening shield member 75 and the insertion part shield member 175.

In this embodiment, while the projection 176 is provided on the insertion part shield member 175, the projection 176 may be formed to protrude upward on the upper surface of the spring part 77 of the insertion opening shield member 75 instead of the insertion part shield member 175.

The plurality of the spring parts 77 (four in the illustrated example) and the projections 176 are formed so that the insertion opening shield member 75 and the insertion part shield member 175 come into contact with each other at multiple points. That is, multipoint contact is provided between the receptacle shield member 71 and the plug shield member 171, thus stabilizing the ground contact resistance between the receptacle connector shield member 71 and the plug connector shield member 171.

The spring part 77 produces an upward force, which exerts a downward force on the legs 76 supporting both ends of the spring part 77. The connecting leg part 76*a* of the leg 76 is pushed against the ground pad of the board 91. The connecting leg part 76*a* of the leg 76 prevents the solder-based connecting part between the connecting leg part 76*a* and the ground pad on the board 91 from being peeled off, thus surely maintaining electrical continuity between the receptacle shield member 71 and the board 91. For example, even in case an external force such as torsion is exerted on the receptacle connector 1 via the wire 191 and the connector 101, it is possible to surely maintain electrical continuity between the receptacle shield member 71 and the board 91.

The plurality of legs 76 (eight in the illustrated example) are formed so that the receptacle shield member 71 and the board 91 come into contact with each other at multiple points. That is, multipoint contacts are provided between the receptacle shield member 71 and the board 91, thus stabilizing the ground contact between the receptacle shield member 71 and the board 91.

The receptacle connector 1 and its insertion opening shield member 75 contact the insertion part shield member 175 covering part of the lower surface of the insertion part 115 as well as a receptacle shield member 71 covering part of the receptacle housing 11, while the legs 76 are connected to ground pads on the circuit board 91.

This obtains a sufficient contact force by way of the thin spring part 77, thus maintaining a secure contact with the insertion part shield member 175 of the plug connector 101 as well as a secure connection between the legs 76 and the ground pad on the board 91, thereby providing a high shielding property and contact reliability. It is thereby possible to reduce the height of the receptacle connector 1.

The spring part 77 or the insertion part shield member 175 includes the projection 176 formed on the surface thereof. When the spring part 77 or the insertion part shield member 175 abuts against the projection 176, the spring part 77 is elastically displaced downward. A reaction force produced by the spring part 77 pushes the spring part 77 against the insertion part shield member 175. This securely maintains a contact between the spring part 77 and the insertion part shield member 175, thus surely maintaining electrical continuity between the insertion opening shield member 75 and the insertion part shield member 175.

The spring part 77 includes the guide part 77*a* configured to extend obliquely downward in a forward direction from the front end thereof. This smoothly guides the insertion part 115 into the insertion opening 13. The spring part 77 is less likely to be deformed, thus allowing adjustment to obtain a greater contact force.

The distance between the spring part 77 and the board 91 is set so that the spring part 77 does not come into contact with the board 91 even when displaced downward. This avoids a state where the spring part 77 is in contact with the board 91 and is not displaced further thus failing to obtain a predetermined elastic region. It is possible to wire a conductive trace in a range corresponding to the lower surface of the spring part 77 on the surface of the board 91, thus enhancing the freedom of wiring of a conductive trace and freedom of design of the board 91.

The leg 76 includes the connecting leg part 76*a* positioned below the insertion opening shield member 75 and configured to come into contact with the ground pad on the board 91. The connecting leg part 76*a* has a curved side shape and the lower surface thereof is separated apart from the surface of the board 91 at a base side connected to the insertion opening shield member 75 and at a free end side, thus forming the cavity portion 76*b* between the upper surface of the connecting leg part 76*a* and the lower surface of the insertion opening shield member 75. This forms a solder fillet in the part, thus increasing the strength of soldering between the leg 76 and the ground pad on the board 91 as well as preventing solder wicking on the shield member 75 or the spring part 77.

The present invention is not limited to the above-described embodiments, and may be changed in various ways based on the gist of the present invention, and these changes are not eliminated from the scope of the present invention.

What is claimed is:

1. A board connector, the board connector comprising:

a housing, the housing including an exterior circumference, the exterior circumference being defined by a top plate, a bottom plate and side walls, and an insertion opening into which an insertion part of a mating connector is inserted; and a shield member, the shield member including an insertion opening shield member, the insertion opening shield member covering at least a portion of the exterior circumference and including a portion arranged forward of the bottom plate for contacting an insertion part shield member of the mating connector covering a portion of a lower surface of the insertion part;

wherein the insertion opening shield member further includes:

a plurality of legs, for connecting to conductive pads of a circuit board, and a spring part, the spring part:

extending widthwise of the insertion opening, having a length greater than the depth of the insertion opening, having its two opposing ends thereof supported by the legs, and contacting the insertion part shield member when the insertion part is inserted into the insertion opening.

2. The board connector according to claim 1, wherein each leg includes a connecting leg part formed by downwardly bending a projecting piece protruding from the insertion opening shield member.

3. The board connector according to claim 2, wherein the connecting leg part is formed so that a tip of the projecting piece is positioned between the insertion opening shield member and the circuit board.

4. The board connector according to claim 3, wherein the connecting leg part has a side shape, curved at a base part thereof, connected to the insertion opening shield member to form a cavity between the base part and a lower surface of the insertion opening shield member, while allowing the tip to be spaced apart from the circuit board.

5. The board connector according to claim 2, wherein each leg is supported by the circuit board, while permitting the connecting leg part to be soldered to a conductive pad on the circuit board.

6. The board connector according to claim 1, wherein the spring part has a projection formed on a surface thereof.

7. The board connector according to claim 5, wherein the spring part includes a guide part that extends obliquely downward in a forward direction from a front end thereof.

8. The board connector according to claim 5, wherein the spring part is elastically displaced downward when the mating connector insertion part is inserted into the insertion opening.

9. The board connector according to claim 8, wherein a distance between the spring part and the circuit board is such that the spring part does not contact the circuit board.

10. The board connector according to claim 1, wherein the insertion part shield member has a projection formed on a surface thereof.

* * * * *